United States Patent [19]

Dürwald et al.

[11] 4,392,434

[45] Jul. 12, 1983

[54] TURBULENT WATERWAY

[75] Inventors: Dierk Dürwald; Karl-Ernst Kaufmann, both of Wetter, Fed. Rep. of Germany

[73] Assignee: Mannesmann Demag AG, Dusseldorf, Fed. Rep. of Germany

[21] Appl. No.: 233,192

[22] Filed: Feb. 10, 1981

[51] Int. Cl.[3] ..... A63G 21/18; B65G 17/06

[52] U.S. Cl. ..... 104/70; 104/63; 104/73; 104/165; 104/172 B; 104/245; 272/32; 272/56.5 R

[58] Field of Search ..... 104/70, 73, 56, 66, 104/35, 53, 58, 119–121, 125, 130, 165, 167, 245, 253, 172 R, 63, 64; 198/472, 580; 272/32, 34, 51, 56.5; 405/119

[56] References Cited

U.S. PATENT DOCUMENTS

| | | | |
|---|---|---|---|
| 760,503 | 5/1904 | Welsh | 104/73 |
| 783,425 | 2/1905 | Folks | 104/35 |
| 1,095,965 | 5/1914 | Glazier | 104/63 |
| 1,399,469 | 12/1921 | Cucullu | 104/70 |
| 1,520,217 | 12/1924 | Auperl | 104/70 |
| 3,113,528 | 12/1963 | Morgan et al. | 104/73 |
| 3,404,635 | 10/1968 | Bacon et al. | 104/70 |
| 3,865,041 | 2/1975 | Bacon | 104/73 X |
| 4,145,042 | 3/1979 | Becker et al. | 272/56.5 R |
| 4,196,900 | 4/1980 | Becker et al. | 272/56.5 R |
| 4,279,337 | 7/1981 | Kachnik | 104/165 X |
| 4,337,704 | 7/1982 | Becker et al. | 104/70 |

FOREIGN PATENT DOCUMENTS

| | | | |
|---|---|---|---|
| 150883 | 10/1937 | Austria | 104/165 |
| 554480 | 2/1957 | Belgium | 104/172 B |
| 2807 | of 1912 | United Kingdom | 104/119 |
| 205988 | 1/1923 | United Kingdom | 104/69 |

*Primary Examiner*—Joseph F. Peters, Jr.
*Assistant Examiner*—Mitchell J. Hill
*Attorney, Agent, or Firm*—Mandeville & Schweitzer

[57] ABSTRACT

Disclosed is a turbulent waterway having boats guided in a trough extending between an uphill starting point and a downhill terminus, a chain conveyor having a series of links extending on a slope between said starting point and said terminus and adapted to travel upwardly therebetween, at least one locking bar with transverse grooves is adapted to mesh with the links of said chain conveyor supporting said links for sliding therealong.

5 Claims, 4 Drawing Figures

TURBULENT WATERWAY

BACKGROUND AND SUMMARY OF PRESENT INVENTION

The present invention relates to a recreational turbulent-waterway having boats guided in a trough extending from an uphill location to a lower terminus. The boats are transported uphill by a special suspension-chain conveyor arrangement. In the case of an earlier waterway installation according to U.S. Pat. No. 783 425 patented on Feb. 28, 1905, there is a danger that the boats may slide down when traversing a steep incline.

The object of the present invention, therefore, is to develop a safe support, for a boat on a chain conveyor, which is suitable and safe for traversing inclines in recreational facilities. This problem is solved by providing each boat under its bottom with at least one profile locking bar having transverse grooves, the protruding elements of which are shaped and sized to mesh with mating projections and indentations of the chain conveyor, the links of which are supported on a sliding surface. The locking bar indentations in cooperation with the links secure the boat with the chain conveyor and assure safe transport uphill. In order to muffle sounds, the locking bar may be made of resilient material.

In a further embodiment of the present invention, the locking bar has a gap or is otherwise interrupted at approximately the center of the length of the boat. This gap or interruption prevents the boat from being lifted up in the center, or from swaying as it traverses rough and uneven surfaces, which may occur in case of an imprecise installation of the sliding surface. Two locking bars are preferably arranged in parallel on both sides of the boat for engagement with chain conveyors in parallel to one another. The chains at their upper and lower ends, are guided around guide wheels rotating about horizontal axes. A separate guide may be arranged at the chain conveyor for recreational boats equipped with guide rollers.

According to a further characteristic of the present invention, the sliding surface is provided with a groove for the vertical links of the chain conveyor. The elements protruding beyond the horizontal elements of the links mesh with the transverse grooves of the locking bar. This type of a link chain is not expensive, and in the event it has lengthened appreciably, it may easily be shortened by maintenance workers by removing a link(s). This, eliminates the expensive tightening equipment which is usually necessary in conveyor installations. The link chain of the present invention produces only minimal noise as it slides across the supporting sliding surface of the chain conveyor and, therefore, is environmentally sound, which is, of course of special importance in recreational facilities. Owing to the form-lock feature, there is no need for back stops for the boats.

For a better understanding of the invention and fuller appreciation of its attendant advantages reference should be made to an exemplary embodiment of the present invention shown in the accompanying drawings and explained in detail hereinafter.

DETAILED DESCRIPTION OF INVENTION

Figure 1:
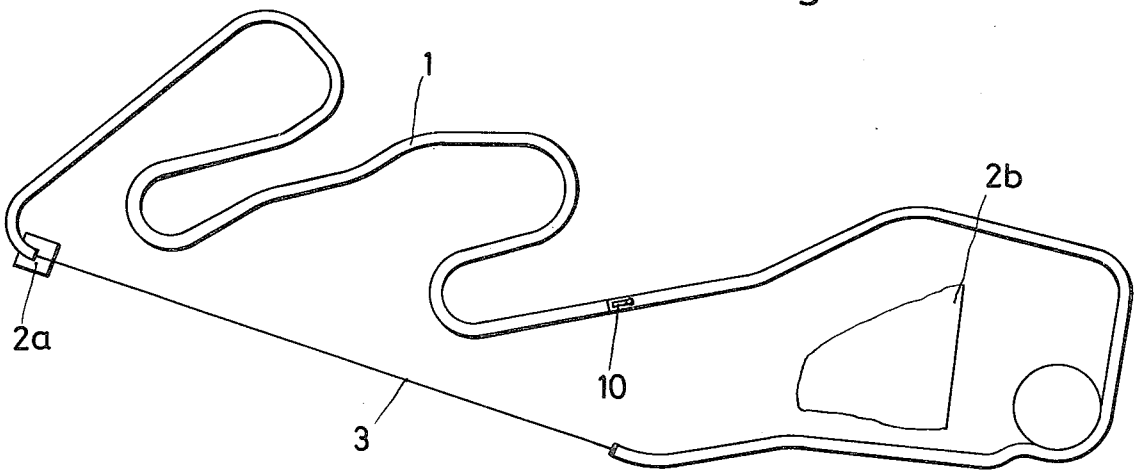
FIG. 1 is a plan view of a turbulent-waterway with a chain conveyor mounted on a slope.

FIG. 1 shows a turbulent-waterway with a trough 1 for boats 10. The trough has an incline of 0.5 to 2%, and connects an upper water basin 2*a* with a lower water basin 2*b* from which latter basin a chain conveyor 3 leads to the upper water basin 2*a* for transporting the boats 10 upwardly.

Figure 2:
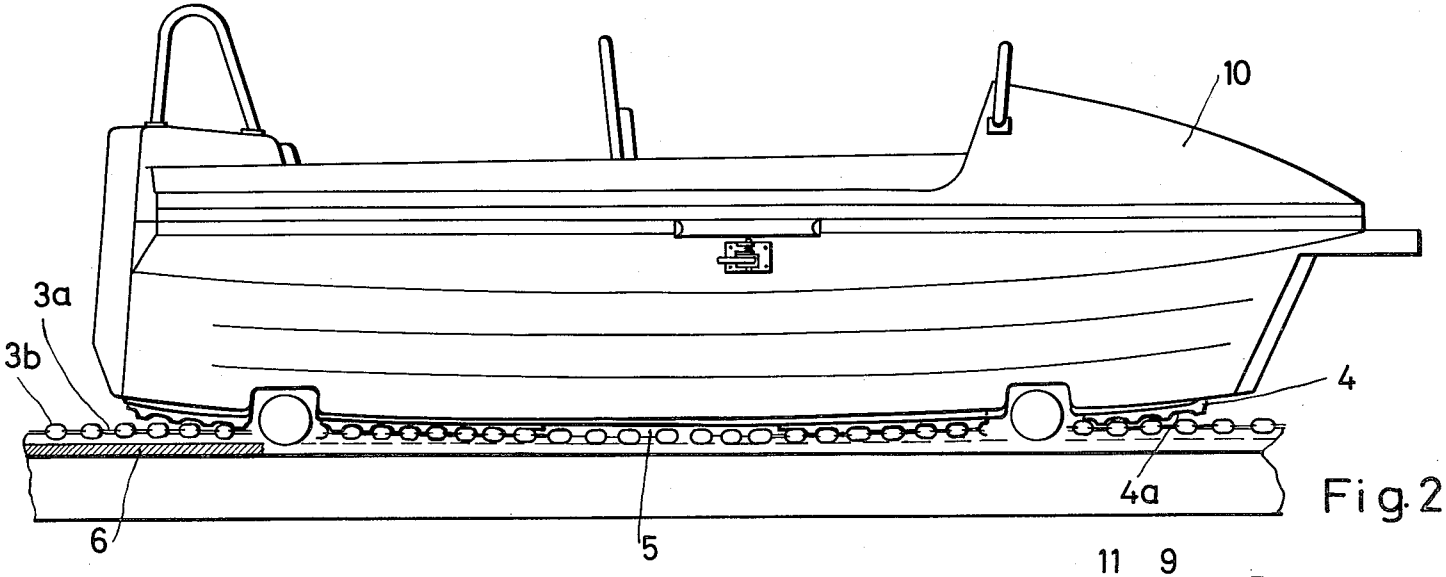
FIG. 2 is a side elevational view of a boat on a portion of the chain conveyor.
Figure 4:
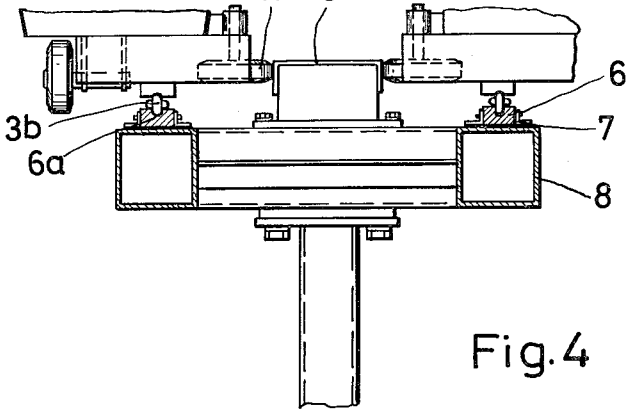
FIG. 4 is a portion from FIG. 3, on a larger scale.
Figure 3:
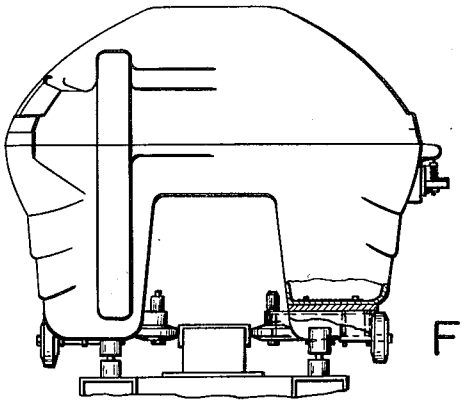
FIG. 3 is a rear elevational view of the boat with a portion broken away to show details of construction.

FIG. 2 shows a boat 10 on a chain conveyor 3, in which the boat and the chain conveyor are shown in a horizontal position for ease of explanation and illustration. The chain conveyor 3 consists of two parallel link chains having horizontal chain links 3*a* which contact sliding support surfaces 6 and having vertical chain links 3*b* arranged for guided movement in grooves 6*a* of the sliding support surface 6. The chain links 3*a*, 3*b*, are adapted to mesh with mating surfaces including transverse grooves 4*a* formed on the bottom of a locking bar 4 arranged underneath the boat 10 on both sides in registry with the chain conveyors 3. The locking bars 4 have interruptions 5 at the central portions thereof. The sliding surfaces 6 are supported, through sound-absorbing rubber underbearings 7, on a suitable supporting structure 8. The chain coveyors 3 have guides 9 for guiding rollers 11 of the boats 10 as shown in FIGS. 3 and 4.

We claim:

1. In a turbulent waterway having boats guided in a water trough extending between an uphill starting point and a downhill terminus water basin, (a) a chain conveyor means having a series of links extending on a slope between said starting point and said terminus water basin and adapted to travel upwardly therebetween, said chain conveyor means being substantially comprised of alternating vertically and horizontally oriented chain links, each of which has rounded edges;

(b) the underside of said boats being provided along their length with at least one lengthwise extending locking bar means with transverse grooves adapted to mesh with the horizontally oriented chain links of said chain conveyor;

(c) said chain conveyor means, when moving at a selected speed, serving to initially, upon contact between said chain conveyor means and said locking bar means, pull said boat at a speed less than said selected speed until said boat accelerates to said selected speed whereupon said chain conveyor means meshes with said locking bar means; and (d) sliding support means for supporting said chain links for sliding therealong, said sliding support means having a vertically oriented groove for guiding said vertically oriented chain links such that said horizontally oriented chain links mesh with said transverse grooves of said locking bar means.

2. A turbulent waterway in accordance with claim 1, further characterized in that (a) the locking bar means is made of resilient material.

3. A turbulent waterway in accordance with claim 1, further characterized in that (a) said locking bar means defines a gap along its length at approximately the center of the length of the boat.

4. A turbulent waterway in accordance with claim 1 characterized in that (a) a pair of locking bar means is arranged in parallel at sides of the boats; and (b) a pair of chain conveyor means is adapted to engage said locking bar means.

5. A turbulent waterway in accordance with claim 1, further characterized in that (a) a central guide means for said boats is provided;

(b) guiding rollers are arranged on said boats to engage said guide means; and (c) said guide means is disposed parallel with the direction of movement of said chain conveyor means.

* * * * *